US006222569B1

(12) United States Patent
Kerr et al.

(10) Patent No.: US 6,222,569 B1
(45) Date of Patent: Apr. 24, 2001

(54) LASER THERMAL PRINTER WITH DUAL DIRECTION IMAGING

(75) Inventors: Roger S. Kerr, Brockport; John D. Gentzke; Robert W. Spurr, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/217,730

(22) Filed: Dec. 21, 1998

(51) Int. Cl.[7] ..... B41J 2/325
(52) U.S. Cl. ..... 347/172; 347/215
(58) Field of Search ..... 347/234, 172, 347/174, 175, 180, 193, 215

(56) References Cited

U.S. PATENT DOCUMENTS

| | | | | |
|---|---|---|---|---|
| 4,550,320 | * | 10/1985 | Biser et al. | 400/126 |
| 5,151,797 | | 9/1992 | Nosaki et al. | 358/474 |
| 5,220,348 | | 6/1993 | D'Aurelio | 347/236 |
| 5,258,776 | | 11/1993 | Guy et al. | 347/237 |
| 5,268,708 | | 12/1993 | Harshbarger et al. | 250/139 |
| 5,276,464 | | 1/1994 | Kerr et al. | 346/134 |
| 5,315,320 | | 5/1994 | Murano | 347/237 |
| 5,642,146 | * | 6/1997 | Uchiyama | 347/130 |
| 5,812,175 | | 9/1998 | Kerr et al. | 347/238 |
| 5,973,717 | * | 3/1987 | Kerr et al. | 347/234 |

* cited by examiner

*Primary Examiner*—N. Le
*Assistant Examiner*—Lamson D. Nguyen
(74) *Attorney, Agent, or Firm*—David A. Novais; Nelson Adrian Blish

(57) ABSTRACT

An image processor comprises on imaging drum (300) for print media (32) and donor sheet materials (36) in registration on vacuum imaging drum (300). A printhead (500) moves along a line parallel to a longitudinal axis of vacuum imaging drum (300) as vacuum imaging drum (300) rotates to provide for an intended image. The intended image may be written in a first direction and/or second direction based on the direction of rotation of vacuum imaging drum (300) and the linear direction of movement of the printhead (500).

7 Claims, 7 Drawing Sheets

LASER THERMAL PRINTER WITH DUAL DIRECTION IMAGING

CROSS REFERENCE TO RELATED APPLICATIONS

The present application is related to U.S. patent application Ser. No. 09/144,123, filed Aug. 31, 1998, by Roger Stanley Kerr and Robert W. Spurr titled "Linear Translation System Dithering For Improved Image Quality Of An Intended Image".

FIELD OF THE INVENTION

The present invention relates to image processors in general and in particular to a laser thermal printer having the capability of printing images in a forward direction and a reverse direction.

BACKGROUND OF THE INVENTION

Pre-press color proofing is a procedure that is used by the printing industry for creating representative images of printed material, without the high cost and time that would be required to produce printing plates and set up a high-speed, high-volume, printing press to produce an example single of an intended image. These intended images may require several corrections and may need to be reproduced several times to satisfy or meet the requirements of customers, resulting in a large loss of profits and ultimately higher cost to the final customer.

One such commercially available image processing apparatus, which is depicted in commonly assigned U.S. Pat. No. 5,268,708 is an image processing apparatus having half-tone color proofing capabilities. This image processing apparatus is arranged to form an intended image on a sheet of thermal print media by transferring colorant from a sheet of donor material to the thermal print media by applying a sufficient amount of thermal energy to the donor sheet material to form an intended image. This image processing apparatus is comprised generally of a material supply assembly or carousel, a lathe bed scanning subsystem (which includes a lathe bed scanning frame, a translation drive, a translation stage member, a printhead, and vacuum imaging drum), and thermal print media and donor sheet material exit transports.

The operation of the image processing apparatus as described above comprises metering a length of the thermal print media (in roll form) from the material assembly or carousel. The thermal print media is then measured and cut into sheet form of the required length, transported to the vacuum imaging drum, registered, wrapped around and secured onto the vacuum imaging drum. Next a length of donor material (in roll form) is also metered out of the material supply assembly or carousel, measured and cut into sheet form of the required length. It is then transported to and wrapped around the vacuum imaging drum, such that it is superposed in the desired registration with respect to the thermal print media (which has already been secured to the vacuum imaging drum).

After the donor sheet material is secured to the periphery of the vacuum imaging drum, the scanning subsystem or write engine provides the scanning function. This is accomplished by retaining the thermal print media and the donor sheet material on the spinning vacuum imaging drum while it is rotated past the print head that will expose the thermal print media. The translation drive then traverses the print head and translation stage member axially along the vacuum imaging drum, in coordinated motion with the rotating vacuum imaging drum. These movements combine to produce the intended image on the thermal print media.

After the intended image has been written on the thermal print media, the donor sheet material is then removed from the vacuum imaging drum. This is done without disturbing the thermal print media that is beneath it. The donor sheet material is then transported out of the image processing apparatus by the donor sheet material exit transport. Additional donor sheet materials are sequentially superimposed with the thermal print media on the vacuum imaging drum, then imaged onto the thermal print media as previously mentioned, until the intended image is completed. The completed image on the thermal print media is then unloaded from the vacuum imaging drum and transported to an external holding tray on the image processing apparatus by the receiver sheet material exit transport.

Although the presently known and utilized image processing apparatus is satisfactory, it is not without drawbacks. In an image processing apparatus, as the imaging drum spins, the printhead moves along the vacuum imaging drum in a path that is parallel to the longitudinal axis of the vacuum imaging drum (referred to as the slow scan). The translation drive moves the printhead in the "slow scan" direction, from a home position (at the point where it begins writing the intended image using the data from the image processing apparatus) to the opposite end of the vacuum imaging drum. The combined movement of the printhead and the vacuum imaging drum rotation perpendicular to the motion of the printhead causes the resulting image to be written in a single, continuous helix about the vacuum imaging drum. However, with the present image processing apparatus, at the end of a writing cycle the printhead must be returned to the home position before writing the next color in order to assure, for example, color to color registration. Returning the printhead to the home position prior to unloading and loading of media and for the start of the next image scan adversely affects the throughput of the image processing apparatus.

SUMMARY OF THE INVENTION

An object of the present invention is to provide for an image processing apparatus that is capable of printing an image without a substantial loss of time or throughput when the printhead is returned to the home position at the end of a writing pass.

According to one embodiment of the present invention, an image processing apparatus for processing thermal print media comprises a vacuum imaging drum for holding thermal print media and colorant donor sheet material in registration; and a printhead, wherein a rotation of the vacuum imaging drum and lead screw can be reversed to allow the printhead to write in both a forward and a reverse linear direction.

According to another embodiment of the invention, the printhead is at an angle to a longitudinal axis of the vacuum imaging drum. In this embodiment, as the vacuum imaging drum is rotated in a reverse direction, channel delay signals are reversed when printing the intended image in a reversed direction.

The present invention permits the printhead to be positioned at the nearest home position at either end of the slow scan travel. This minimizes the time it takes to move the printhead to a home position to allow loading and unloading of the thermal print media and donor sheet material. In the case that the printhead is not required to be moved to a home position for loading and unloading of the thermal print media and donor sheet material, their would be no time required to move the printhead to a home position.

The present invention relates to an image processing apparatus which can write images in a forward direction and a reverse direction. The apparatus comprises a writing assembly; a translation assembly for moving the writing assembly; and a rotatable imaging member adapted to receive media thereon. The translation assembly moves the writing assembly in a forward linear direction and a reverse linear direction, such that a writing pass can be written on media on the imaging member in either of the forward linear direction or the reverse linear direction.

The present invention also relates to an image processing method which comprises the steps of loading media on a rotatable imaging member; and moving a writing assembly with respect to a surface of the imaging member in one of a first linear direction or a second linear direction which is opposite to the first linear direction, to provide for a writing pass on the media.

The present invention also relates to an image processing apparatus which comprises a writing assembly; a translation assembly for moving the writing assembly; a rotatable imaging member adapted to receive media thereon; and a control device operationally associated with the translation assembly and the imaging member to control a linear movement of the writing assembly and a rotation of the imaging member. The control device is adapted to cause a movement of the writing assembly in a forward linear direction and a rotation of the imaging member in a first direction, and being further adapted to cause a movement of the writing assembly in a reverse linear direction and a rotation of the imaging member in a second direction opposite to the first direction, such that at least one writing pass can be written on media on the imaging member in either of the forward linear direction or the reverse linear direction.

The present invention also relates to an image processing apparatus which comprises a writing assembly that is adapted to move in a forward linear direction and a reverse linear direction relative to a surface of a rotatable imaging drum, such that an image can be written on media on the imaging drum in either of the forward linear direction or the reverse linear direction based on a direction of rotation of the imaging drum and a linear direction of movement of the writing assembly.

DETAILED DESCRIPTION OF THE INVENTION

Figure 1:
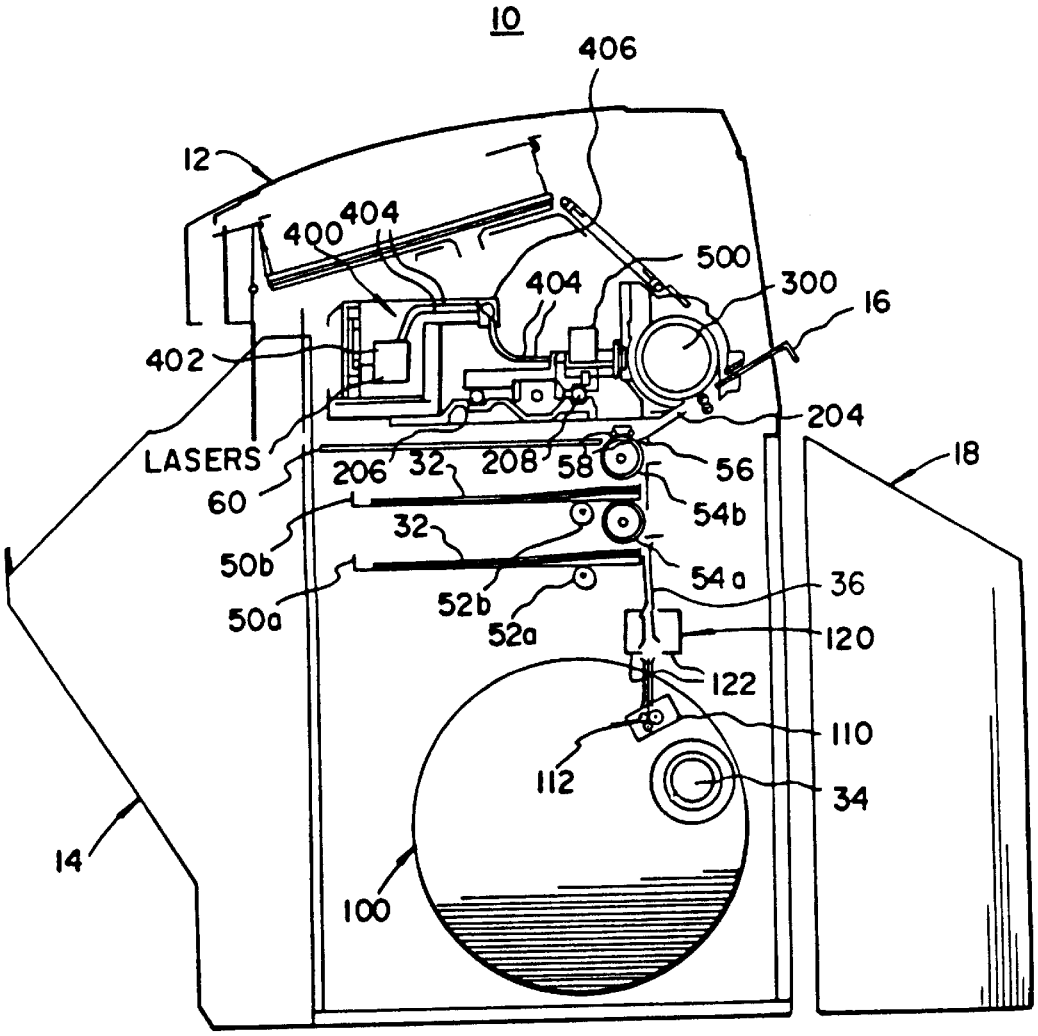
FIG. 1 is a side view in vertical cross section of an image processing apparatus according to the present invention.

Referring to FIG. 1 wherein like reference numerals designate identical or corresponding parts throughout the several views, FIG. 1 shows an image processing apparatus 10 according to the present invention. Image processing apparatus 10 includes an image processor housing 12 which provides a protective cover. A movable, hinged image processor door 14 is attached to the front portion of the image processor housing 12 permitting access to a lower sheet material tray 50*a* and an upper sheet material tray 50*b*, that are positioned in an interior portion of the image processor housing 12 and support thermal print media 32, thereon. Only one of the sheet material trays 50*a*, 50*b* will dispense thermal print media 32 out of its sheet material tray to create an intended image thereon; the alternate sheet material tray 50*a*, 50*b* either holds an alternative type of thermal print media 32 or functions as a back up sheet material tray. In this regard, the lower sheet material tray 50*a* includes a lower media lift cam 52*a* for lifting the lower sheet material tray 50*a* and ultimately the thermal print media 32, upwardly toward a rotatable, lower media roller 54*a* and toward a second rotatable, upper media roller 54*b* which, when both are rotated, permits thermal print media 32 to be pulled upwardly towards a media guide 56. Sheet material tray 50*b* includes an upper media lift cam 52*b* for lifting upper sheet material tray 50*b* and ultimately thermal print media 32 towards the upper media roller 54*b* which directs it towards media guide 56.

The movable media guide 56 directs thermal print media 32 under a pair of media guide rollers 58 which engages thermal print media 32 for assisting upper media roller 54*b* in directing it onto a media staging tray 60. Media guide 56 is attached and hinged to a lathe bed scanning frame 202 at one end, and is uninhibited at its other end for permitting multiple positioning of media guide 56. Media guide 56 then rotates its uninhibited end downwardly, as illustrated in the position shown, and the direction of rotation of upper media roller 54*b* is reversed for moving thermal print media 32 resting on media staging tray 60 under the pair of media guide rollers 58, upwardly through an entrance passageway 204 and around a rotatable vacuum imaging member such as a vacuum imaging drum 300.

A roll 30 of donor material 34 is connected to a media carousel 100 in a lower portion of image processor housing 12. Four rolls 30 are used, but only one is shown for clarity. Each roll 30 includes a donor material 34 of a different color, typically black, yellow, magenta and cyan. The colorant can be in the form of dyes, inks, pigments etc. These donor materials 34 are ultimately cut into donor sheet materials 36 and passed to vacuum imaging drum 300 for forming the medium from which colorants imbedded therein are passed to thermal print media 32 resting thereon. In this regard, a media drive mechanism 110 is attached to each roll 30 of donor material 34, and includes three media drive rollers 112 through which donor material 34 of interest is metered upwardly into a media knife assembly 120. After the donor material 34 reaches a predetermined position, media drive rollers 112 cease driving the donor material 34 and the two media knife blades 122 positioned at the bottom portion of the media knife assembly 120 cut the donor material 34 into donor sheet materials 36. Lower media roller 54*a* and upper media roller 54*b* along with media guide 56 then pass the donor sheet material 36 onto media staging tray 60, and ultimately to vacuum imaging drum 300 and in registration with thermal print media 32 using the same process as described above for passing thermal print media 32 onto vacuum imaging drum 300. Donor sheet material 36 now rests atop the thermal print media 32 with a narrow gap between the two created by microbeads imbedded in the surface of the thermal print media 32.

Figure 2:
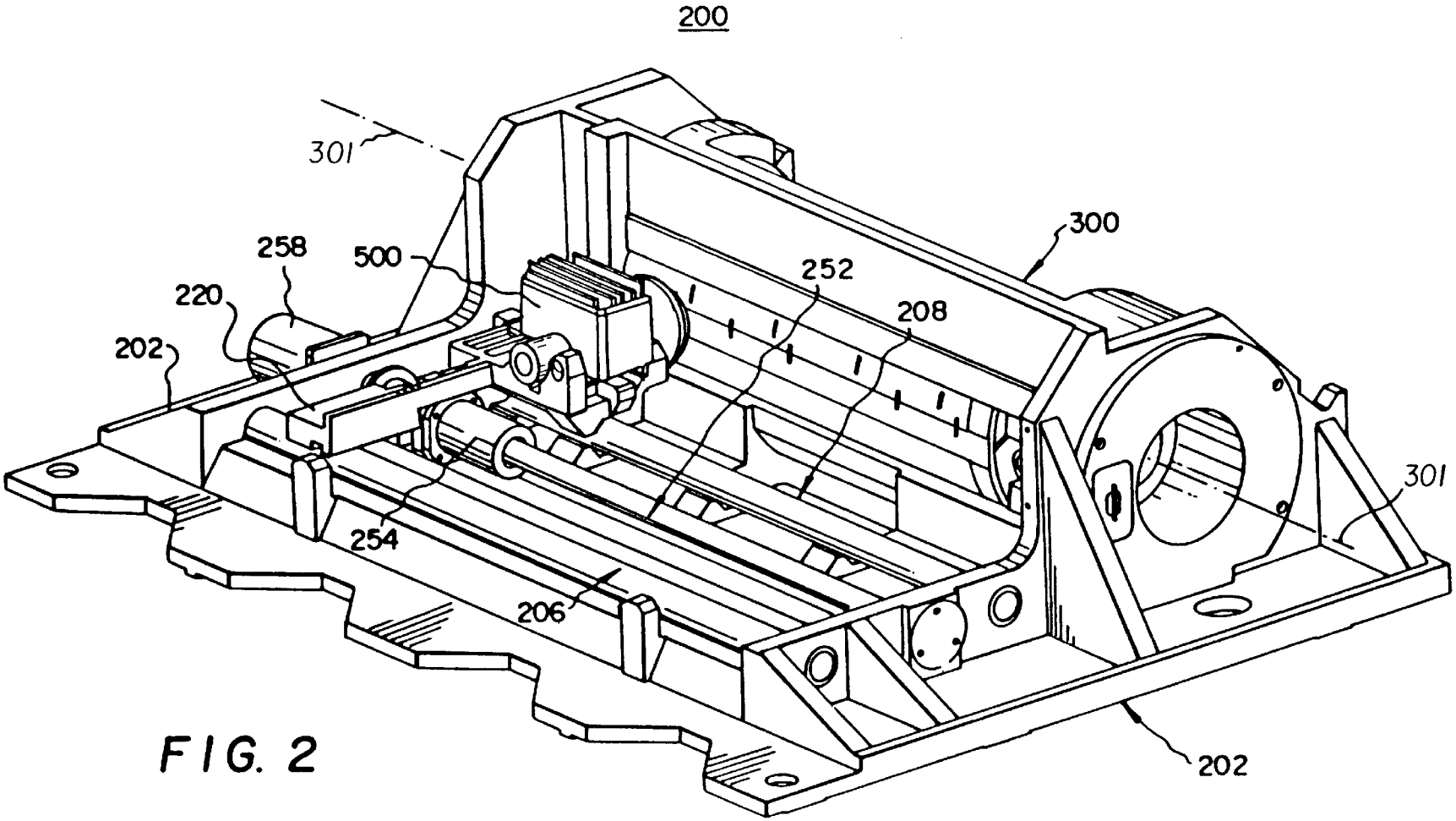
FIG. 2 is a perspective view of a vacuum imaging drum, printhead and lead screw of the present invention.

A laser assembly 400 includes a quantity of laser diodes 402 in its interior. Lasers 402 are connected via fiber optic cables 404 to a distribution block 406 and ultimately to a writing assembly which includes a printhead 500. Printhead 500 directs thermal energy received from laser diodes 402 causing donor sheet material 36 to pass the desired color across the gap to the thermal print media 32. As shown in FIG. 2, printhead 500 is attached to a lead screw 252 via a lead screw drive nut 254 and drive coupling (not shown) for permitting movement axially along a longitudinal axis of vacuum imaging drum 300 for transferring data to create an intended image onto thermal print media 32.

For writing, vacuum imaging drum 300 rotates at a predetermined velocity for each color or material, and printhead 500 begins at one end of thermal print media 32 and traverses the entire length of thermal print media 32 for completing the transfer process for the particular donor sheet material 36 resting on the thermal print media 32. After printhead 500 has completed the transfer process, for the particular donor sheet material 36 resting on thermal print media 32 the donor sheet material 36 is then removed from vacuum imaging drum 300 and transferred out the image processor housing 12 via a skive or ejection chute 16. Donor sheet material 36 eventually comes to rest in a waste bin 18 for removal by the user. The above described process is then repeated for the other three or more rolls 30 of donor materials 34.

After the required amount of color from all sheets of donor sheet materials 36 have been transferred and donor sheet materials 36 have been removed from the vacuum imaging drum 300, thermal print media 32 is removed from vacuum imaging drum 300.

Figure 7:
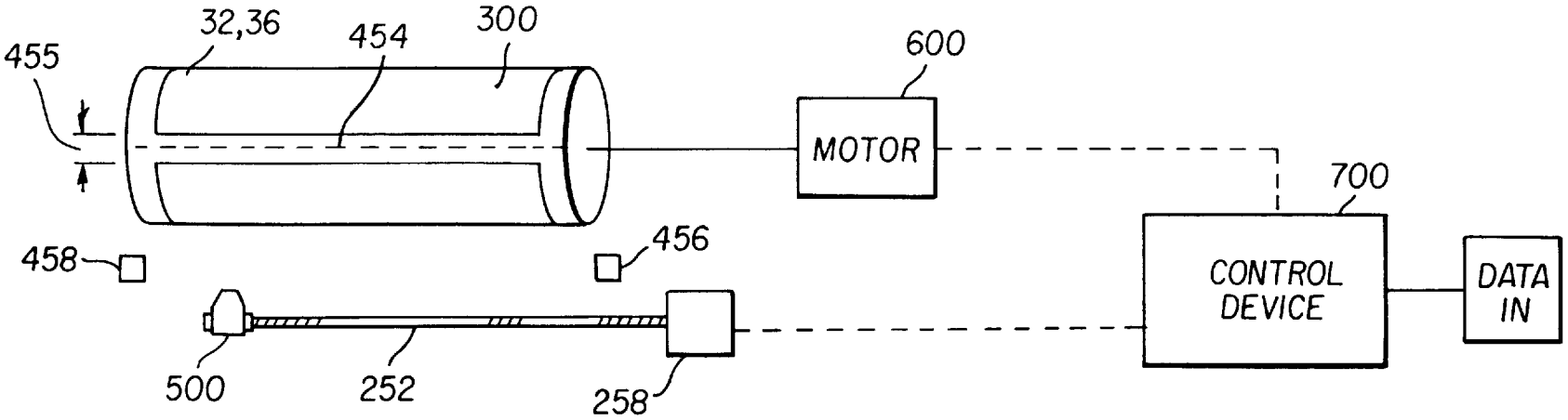
FIG. 7 is a schematic illustration of a control system in accordance with the present invention.

FIG. 2 is a perspective view of a lathe bed scanning subsystem 200 of image processing apparatus 10, including vacuum imaging drum 300, printhead 500 and lead screw 252 assembled in a lathe bed scanning frame 202. A translation assembly or system includes lead screw 252 and a drive motor 258 which drives lead screw 252. Motor 258 can be a stepper motor or servo motor which operates in conjunction with lead screw 252. However, the present invention is not limited to this arrangement. It is recognized that various translation systems such as a motor and belt arrangement where the motor can be a stepper or servo motor, or a linear motor assembly which can be a servo or stepper motor, can be utilized within the context of the present invention. Vacuum imaging drum 300 is mounted for rotation about an axis 301 and a motor 600 as shown in FIG. 7 rotates vacuum imaging drum 300. Printhead 500 is movable with respect to vacuum imaging drum 300, and is arranged to direct a beam of light to donor sheet material 36. The beam of light from printhead 500 for each laser diode 402 (not shown in FIG. 2) is modulated individually by modulated electronic signals from image processing apparatus 10, which are representative of the shape and color of the original image, so that the color on donor sheet material 36 is heated to cause volatilization only in those areas in which its presence is required on thermal print media 32 to reconstruct the shape and color of the original image.

Printhead 500 is mounted on a movable translation stage member 220 which, in turn, is supported for low friction slidable movement on translation bearing rods 206 and 208. Translation bearing rods 206 and 208 are sufficiently rigid so that they do not sag or distort between their mounting points and are arranged as parallel as possible with axis 301 of vacuum imaging drum 300, with the axis of printhead 500 being perpendicular to axis 301 of vacuum imaging drum 300. The front translation bearing rod 208 locates translation stage member 220 in the vertical and the horizontal directions with respect to axis 301 of vacuum imaging drum 300. The rear translation bearing rod 206 locates translation stage member 220 only with respect to rotation of translation stage member 220 about the front translation bearing rod 208, so that there is no over-constraint condition of the translation stage member 220 which might cause it to bind, chatter, or otherwise impart undesirable vibration or jitters to the printhead 500 during the generation of an intended image.

Figure 3:
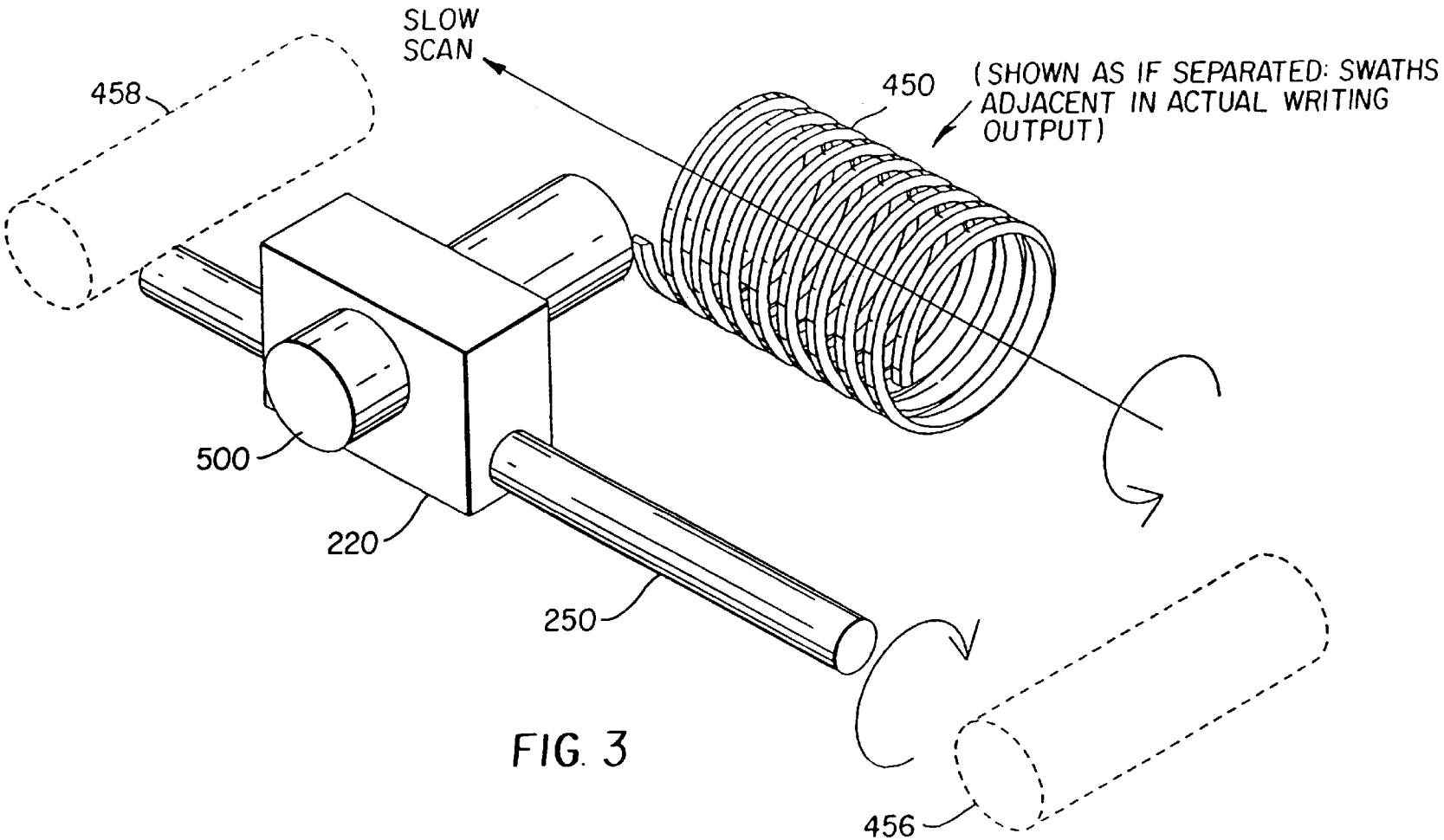
FIG. 3 is a perspective view of a printing swath created by drum rotation and lead screw movement for printing an intended image in a forward direction.
Figure 4:
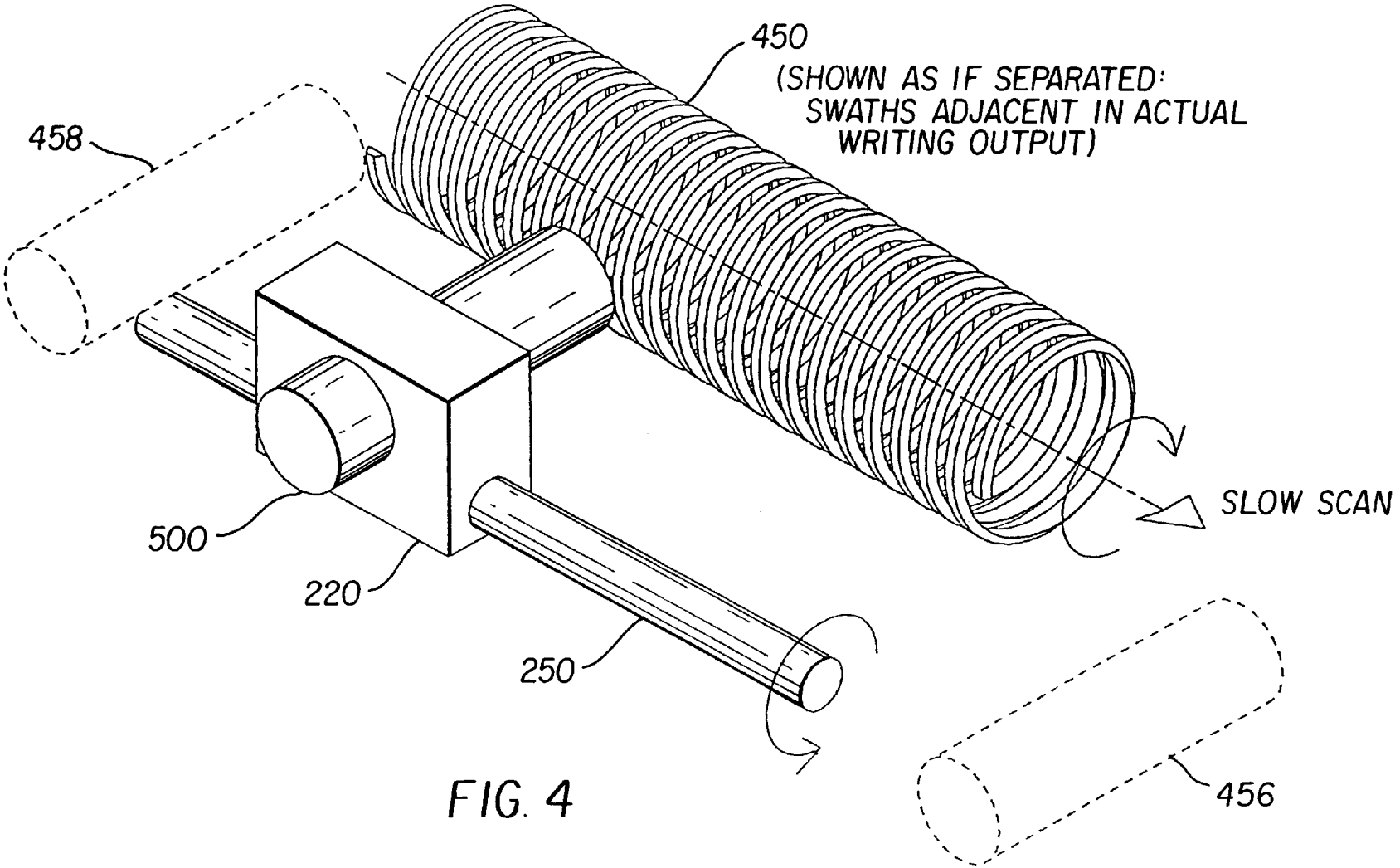
FIG. 4 is a perspective view of a printing swath created by drum rotation and lead screw movement for printing an intended image in a reverse direction.
Figure 5:
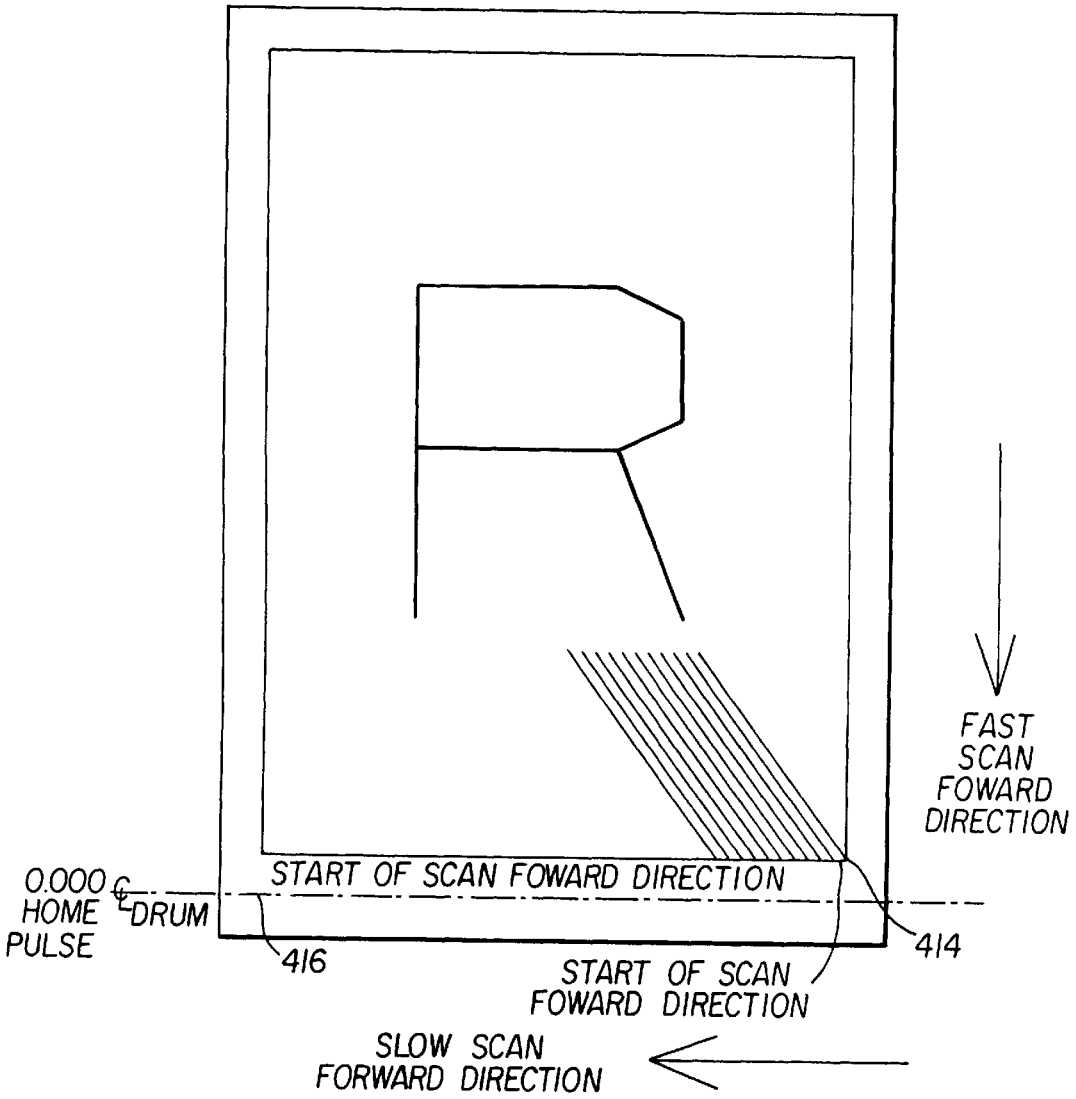
FIG. 5 shows a plan view of the imaging drum and the orientation of data in a forward direction according to the present invention.
Figure 6:
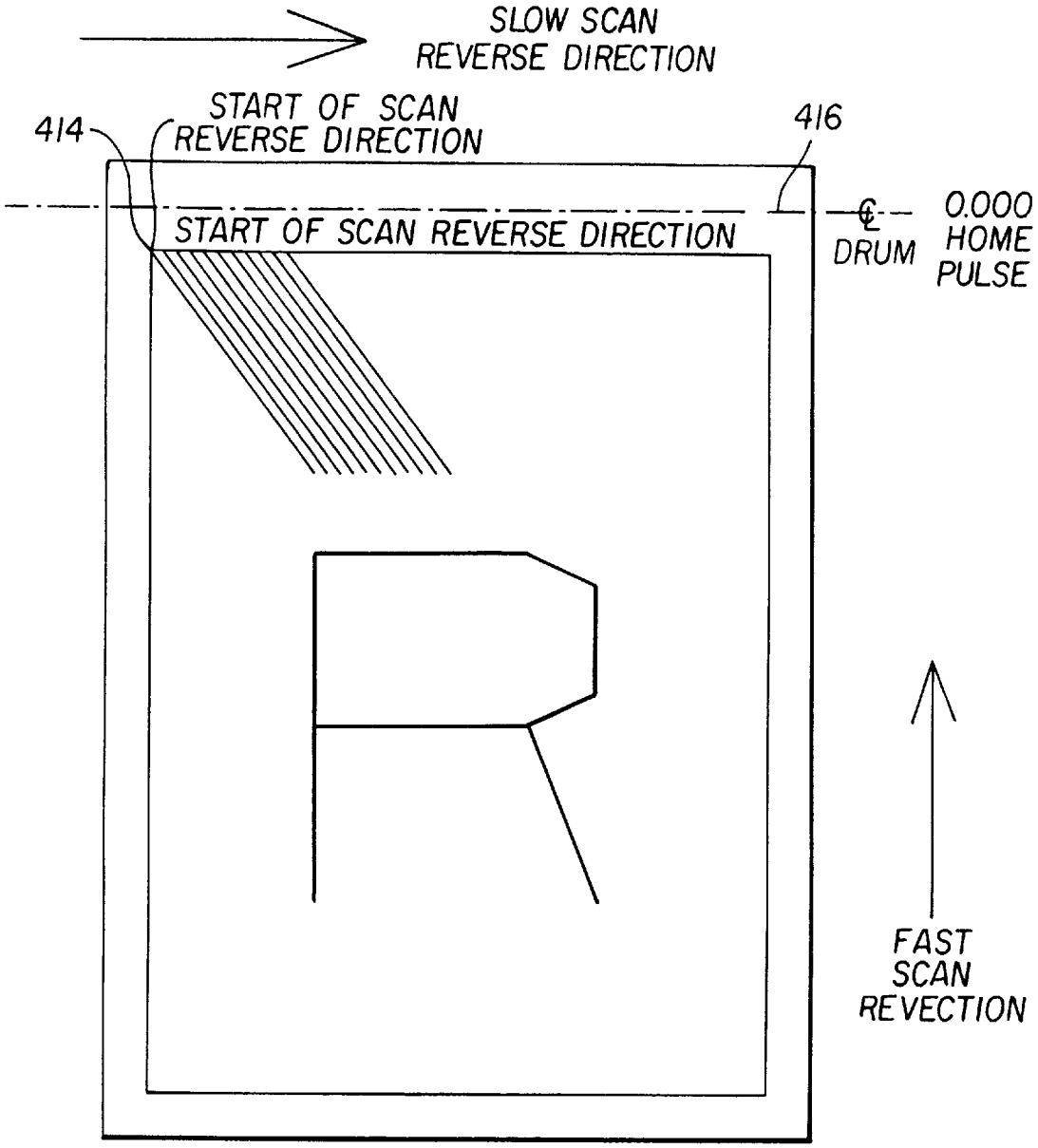
FIG. 6 shows a plan view of the imaging drum and the orientation of the data in a reverse direction according to the present invention.

During operation, motor 258 rotates lead screw 252 to cause a linear travel of printhead 500. Printhead 500 travels in a path along imaging drum 300, moved at a speed synchronous with drum rotation and proportional to the width of a writing swath 450, as shown in FIGS. 3 and 4. The end and/or beginning of the path of travel of printhead 500 is represented by reference numerals 456, 458 which designate home positions for printhead 500. The pattern that printhead 500 traces out along spinning vacuum imaging drum 300 is a helix. Writing swath 450 traced out on vacuum imaging drum 300 are shown separated for purposes of clarity, in actual operation, each writing swath 450 would be directly adjacent to the previous writing swath 450, traced out on the surface of vacuum imaging drum 300. Printhead 500 has a point at which it writes a first pixel 414, as shown in FIG. 5 and FIG. 6, relative to the final image. First pixel 414 is a fixed distance from a drum index mark 454 of vacuum imaging drum 300 which can be preferably located within a non-writing area 455 of drum 300 (FIG. 7) or a writing area, depending on design considerations. This means that printhead 500 writes first pixel 414 at a fixed distance on the surface of vacuum imaging drum 300, after vacuum imaging drum 300 has rotated past printhead 500.

FIG. 7 schematically illustrates a control system in accordance with the present invention. As shown in FIG. 7, a control device 700 such as a processor (CPU) receives data with respect to a line or lines to be written. Control device 700 is operationally associated with motor 258 which drives lead screw 252, as well as motor 600 which rotates drum 300.

In one embodiment of the present invention, thermal print media 32 and a first donor sheet material 36 are loaded onto vacuum imaging drum 300. Based on the data inputted to control device 700, in this embodiment control device 700 controls motors 258 and 600 and thereby controls the drive of printhead 500 and the rotation of drum 300 as follows. With printhead 500 at home position 456, vacuum imaging drum 300 is rotated in a forward writing direction and the translation system which includes motor 258 and lead screw 252 moves printhead 500 in the forward writing direction as shown in FIG. 5. At the end of the first writing pass, motor 258 stops, donor sheet material 36 is replaced, vacuum imaging drum 300 is rotated in a reverse direction, and motor 258 and lead screw 252 are rotated in a reverse direction to move printhead 500 in the reverse direction, as shown in FIG. 6 for a subsequent writing pass. Motor 258 then stops and the process is repeated until the intended image is completed.

In another embodiment of the present invention, thermal print media 32 and a first donor sheet material 36 are loaded onto vacuum imaging drum 300. Based on the data inputted to control device 700, in this embodiment control device 700 controls motors 258 and 600 and thereby controls the drive of printhead 500 and the rotation of drum 300 as follows. With printhead 500 at home position 456, vacuum imaging drum 300 is rotated in the forward writing direction and motor 258 and lead screw 252 move printhead 500 in the forward writing direction. At the end of the first writing pass, motor 258 and lead screw 252 move printhead 500 to second home position 458, donor sheet material 36 is replaced, vacuum imaging drum 300 is rotated in a reverse direction, and the rotation of motor 258 and lead screw 252 are reversed to move printhead 500 in the reverse direction for a subsequent writing pass. Motor 258 then moves the printhead to home position 456 and the process is repeated until the intended image is completed. Sensors are positioned at each of the home positions 456, 458 to indicated the presence of printhead 500 and provide a signal indicative thereof to control device 700.

In another embodiment of the present invention, thermal print media 32 and a first donor sheet material 36 are loaded onto vacuum imaging drum 300. Based on data inputted to control device 700, control device 700 controls motors 258 and 600 and thereby controls the drive of printhead 500 and the rotation of drum 300 as follows. With printhead 500 at home position 456, vacuum imaging drum 300 is rotated in the forward writing direction and motor 258 and lead screw 252 move printhead 500 in the forward writing direction. At the end of the first writing pass, motor 258 and lead screw 252 move printhead 500 to home position 456 or second home position 458 whichever is the closest, donor sheet material 36 is replaced, vacuum imaging drum 300 is rotated in a forward or reverse direction, and motor 258 and lead screw 252 move printhead 500 in a forward or reverse direction for a subsequent writing pass. Motor 258 and lead screw 252 then move printhead 500 to second home position 456 or to second home position 458 whichever is the closest position and the process is repeated until the intended image is completed. The closest home position (456, 458) can be determined based on the count of motor 258 as the printhead is driven in a linear direction. That is, a value for this count is determined by control device 700 and used as a basis to determine the closest of the home positions (456, 458).

In another embodiment of the present invention, thermal print media 32 and a first donor sheet material 36 are loaded onto vacuum imaging drum 300. Based on the data inputted to control device 700, control device 700 controls motors 258 and 600 and thereby controls the drive of printhead 500 and the rotation of drum 300 as follows. With printhead 500 at home position 456, vacuum imaging drum 300 is rotated in the forward writing direction and motor 258 and lead screw 252 move printhead 500 in the forward writing direction. At the end of the first writing pass, motor 258 and vacuum imaging drum 300 stop, vacuum imaging drum 300 is rotated in a reverse direction, motor 258 and lead screw 252 are reversed to move printhead 500 in a reverse direction to write a subsequent writing pass, motor 258 and lead screw 252 move printhead 500 to home position 456, and the process is repeated until the intended image is completed.

In yet another embodiment of the invention printhead 500 is set at an angle in a known manner and channel delays are used to insure proper placement of pixels on a scan lie approximately parallel to the horizontal axis of vacuum imaging drum 300. At a trailing end of each scan, printhead 500 stops writing by activating successively fewer pixels so that the net effect is a rectangular image area. Likewise, at a leading end printhead 500 starts writing by activating successively more pixels so that the net effect is a rectangular image area. Because vacuum imaging drum 300 is rotating, printhead 500 incorporates a set of channel delays so that the pixels line up correctly on the output image. In order to write to vacuum imaging drum 300 spinning in the reverse direction, these delays are reversed. Channel delay timing is executed by control device 700.

In the embodiments of the present invention described above, during a reverse writing pass the image must be electronically inverted because the first pixel is now to last pixel and the last pixel is now the first pixel, and the top of page delay must be adjusted accordingly. In the embodiment where the printhead is at an angle, the above applies, and in addition the channel delays must be reversed.

The invention has been described with reference to the preferred embodiment thereof. However, it will be appreciated and understood that variations and modifications can be effected within the spirit and scope of the invention as described herein above and as defined in the appended claims, by a person of ordinary skill in the art without departing from the scope of the invention. For example, the invention is applicable to any drum. Also, the donor material may have dye, pigments, or other material which is transferred to the thermal print media. Thermal print media includes paper, films, plates, and other material capable of accepting or producing an image. Also, the printhead can be a laser thermal printhead, a resistive thermal printhead or an ink jet printhead.

What is claimed is:

1. An image processing apparatus comprising:

a writing assembly;

a translation assembly for moving said writing assembly;

a rotatable imaging member adapted to receive media thereon;

a control device operationally associated with at least said translation assembly to move said writing assembly in a forward linear direction and a reverse linear direction, such that a writing pass can be written on said media on said imaging member in either of said forward linear direction or said reverse linear direction;

wherein said imaging member is an imaging drum and said media comprises receiver media and donor media mounted on said imaging drum, such that said translation assembly moves said writing assembly in said forward linear direction to write a first writing pass while said imaging drum having said receiver media and donor media mounted thereon rotates in a first direction, and after said first writing pass is completed, said donor media is removed and replaced by a second donor media, said translation assembly thereafter moving said writing assembly in said reverse linear direction to write a second writing pass while the rotation of the imaging drum having said receiver media and second donor media mounted thereon is reversed; and wherein said writing assembly has a first home position located in a vicinity of a beginning of said first writing pass and a second home position located in a vicinity of an end of said first writing pass, said donor media being removed and replaced while said writing assembly is positioned in one of said first or second home positions.

2. An image processing apparatus according to claim 1, wherein said writing assembly comprises a printhead.

3. An image processing apparatus according to claim 1, wherein said translation assembly comprises a drive motor operationally associated with a lead screw which moves said writing assembly.

4. An image processing apparatus according to claim 1, wherein said writing assembly is positioned in one of said first or second home positions which is closest to said writing assembly when the donor media is being removed and replaced.

5. An image processing method comprising the steps of:

loading media on a rotatable imaging member; and moving a writing assembly with respect to a surface of the imaging member in one of a first linear direction or a second linear direction which is opposite to said first linear direction, to provide for a writing pass on the media;

wherein said imaging member is an imaging drum and said step of loading media on said imaging drum comprises loading receiver media on said imaging drum and registering donor media over said receiver media;

wherein said step of moving said writing assembly with respect to said imaging drum comprises the steps of:

moving said writing assembly in said first linear direction to write a first writing pass as said imaging drum rotates in a first direction;

removing said donor media after said first writing pass is completed and replacing said donor media with a second donor media;

moving said writing assembly in said second linear direction while the rotation of said imaging drum is reversed to write a second writing pass; and wherein said writing assembly has a first home position located in a vicinity of a beginning of said first writing pass and a second home position located in a vicinity of an end of said first writing pass, such that said writing assembly is positioned in one of said first or second home positions while said donor media is being removed and replaced.

6. An image processing method according to claim 5, wherein said writing assembly is positioned in one of said first or second home positions which is closest to said writing assembly when the donor media is being removed and replaced.

7. An image processing method according to claim 5, wherein said writing assembly is a printhead.

* * * * *